US011346139B1

(12) United States Patent
Dole, Jr. et al.

(10) Patent No.: US 11,346,139 B1
(45) Date of Patent: May 31, 2022

(54) LIGATURE-RESISTANT HINGE CAP

(71) Applicant: Schlage Lock Company LLC, Carmel, IN (US)

(72) Inventors: Gregory W. Dole, Jr., Indianapolis, IN (US); Maria Shields, Indianapolis, IN (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 17/135,073

(22) Filed: Dec. 28, 2020

(51) Int. Cl.
*E05D 11/00* (2006.01)

(52) U.S. Cl.
CPC .. *E05D 11/0054* (2013.01); *E05D 2011/0072* (2013.01); *E05Y 2900/132* (2013.01)

(58) Field of Classification Search
CPC ..... E05D 11/0054; E05D 2011/0063; E05D 2011/0072; E05D 3/122; E05D 1/00; E05D 7/009; E05C 17/54; E05Y 2900/132; Y10T 16/533; Y10T 16/5335
See application file for complete search history.

(56) References Cited

U.S. PATENT DOCUMENTS 5,991,975 A * 11/1999 Baer ..... E05D 7/009 16/250
9,328,546 B1 * 5/2016 Davis ..... E06B 7/362
RE46,240 E 12/2016 Schau
RE46,280 E 1/2017 Lee et al.
10,385,598 B2 * 8/2019 Shah ..... E05D 3/122
11,002,050 B1 * 5/2021 Wolthuis ..... E05D 1/00
2011/0030168 A1 * 2/2011 Schau ..... E05D 11/0054 16/82
2020/0102776 A1 * 4/2020 Eshuis ..... E05D 11/0054
2021/0127832 A1 * 5/2021 Shahzad ..... F16B 12/10

FOREIGN PATENT DOCUMENTS

GB 2528545 A * 1/2016 ..... E05D 11/0054
GB 2570033 A * 7/2019 ..... E05D 3/122

OTHER PUBLICATIONS

Phoenix; Anti-Ligature, Architectural and Continuous Hinges; Technical Specification—Issue 1; Copyright 2011 Cooke Brothers Ltd.; 4 pages.
SELECT HINGES; Increase Safety with SELECT's Tipit Ligature-Resistant Hospital Tip and Increase Safety with SELECT'S Ligature-Resistant Hospital Tip for New Construction; Copyright 2013 SELECT Products Limited; 2 pages.
Lock Depot; 027XY-US28-95-HT IVES Full Mortise Continuous Geared Hinges with Hospital Tip in Satin Aluminum; accessed Dec. 28, 2020; 4 pages.
Kingsway Group; KG200 Continuous Hinge; Product Datasheet; 1 page.
SELECT HINGES; Select Hospital Tips; Fast, Ligature-Resistant Solutions for Doorways Throughout Your Facility; Copyright 2020 SELECT Products Limited; 5 pages.

* cited by examiner

*Primary Examiner* — Chuck Y Mah
(74) *Attorney, Agent, or Firm* — Taft Stettinius & Hollister LLP

(57) ABSTRACT

A ligature-resistant hinge cap configured for use with a door hinge and generally including a body portion configured for mounting to the hinge, a flange extending rearward from the body portion, a rear side defined by the flange, and a front side opposite the rear side. The body portion includes a downwardly-extending stem configured to extend into a connecting portion of the hinge, and the front side is sloped.

20 Claims, 9 Drawing Sheets

LIGATURE-RESISTANT HINGE CAP

TECHNICAL FIELD

The present disclosure generally relates to hinge caps, and more particularly but not exclusively relates to hinge caps for use in hospital and mental health institutions.

BACKGROUND

One danger facing patients and/or residents of hospitals, mental health institutions, juvenile detention centers, and other facilities is the possibility of self-harm. While self-harm can come in many forms, one common form is by hanging oneself via a ligature attached to a sturdy object, such as a door hardware component. Many facilities attempt to prevent this type of self-harm by reducing the number of surfaces to which such a ligature can be attached, for example by providing the hinges of the door with a sloped cap that inhibits ligatures from being wrapped about the hinge. However, many such ligature-resistant caps suffer from drawbacks and limitations, such as by providing one or more anchor points by which a ligature can be hung from the cap. For these reasons among others, there remains a need for further improvements in this technological field.

SUMMARY

An exemplary ligature-resistant hinge cap is configured for use with a hinge. The ligature resistant hinge cap generally includes a body portion configured for mounting to the hinge, a flange extending rearward from the body portion, a rear side defined by the flange, and a front side opposite the rear side. The body portion includes a downwardly-extending stem configured to extend into a connecting portion of the hinge, and the front side is sloped. Further embodiments, forms, features, and aspects of the present application shall become apparent from the description and figures provided herewith.

DETAILED DESCRIPTION OF ILLUSTRATIVE EMBODIMENTS

Figure 2:
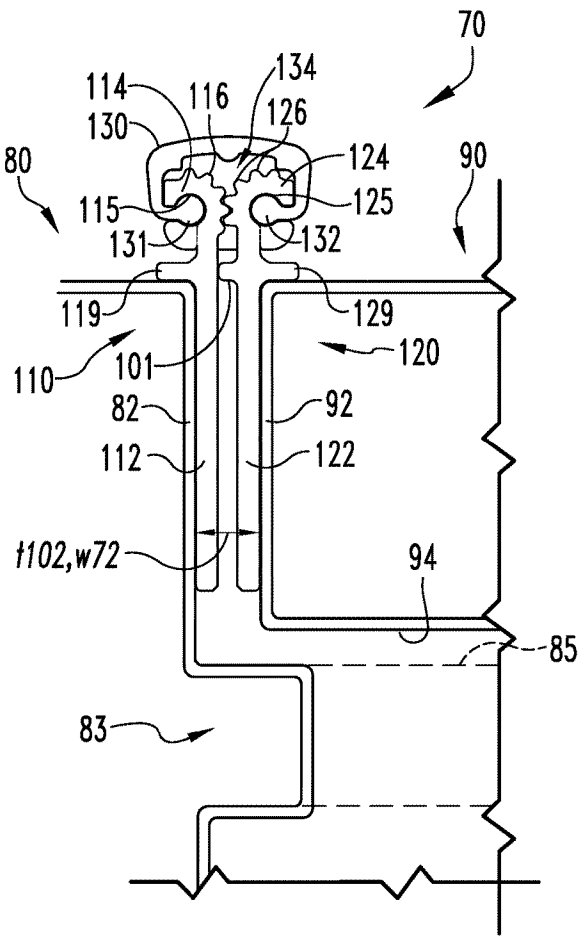
FIG. 2 is a cross-sectional illustration of the closure assembly illustrated in FIG. 1.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Items listed in the form of "A, B, and/or C" can also mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not necessarily be required. Rather, in some embodiments, such features may be arranged in a different manner and/or order than shown in the illustrative figures unless indicated to the contrary.

Additionally, the inclusion of a structural or method feature in a particular figure is not meant to imply that such feature is required in all embodiments and, in some embodiments, may be omitted or may be combined with other features.

Figure 1:
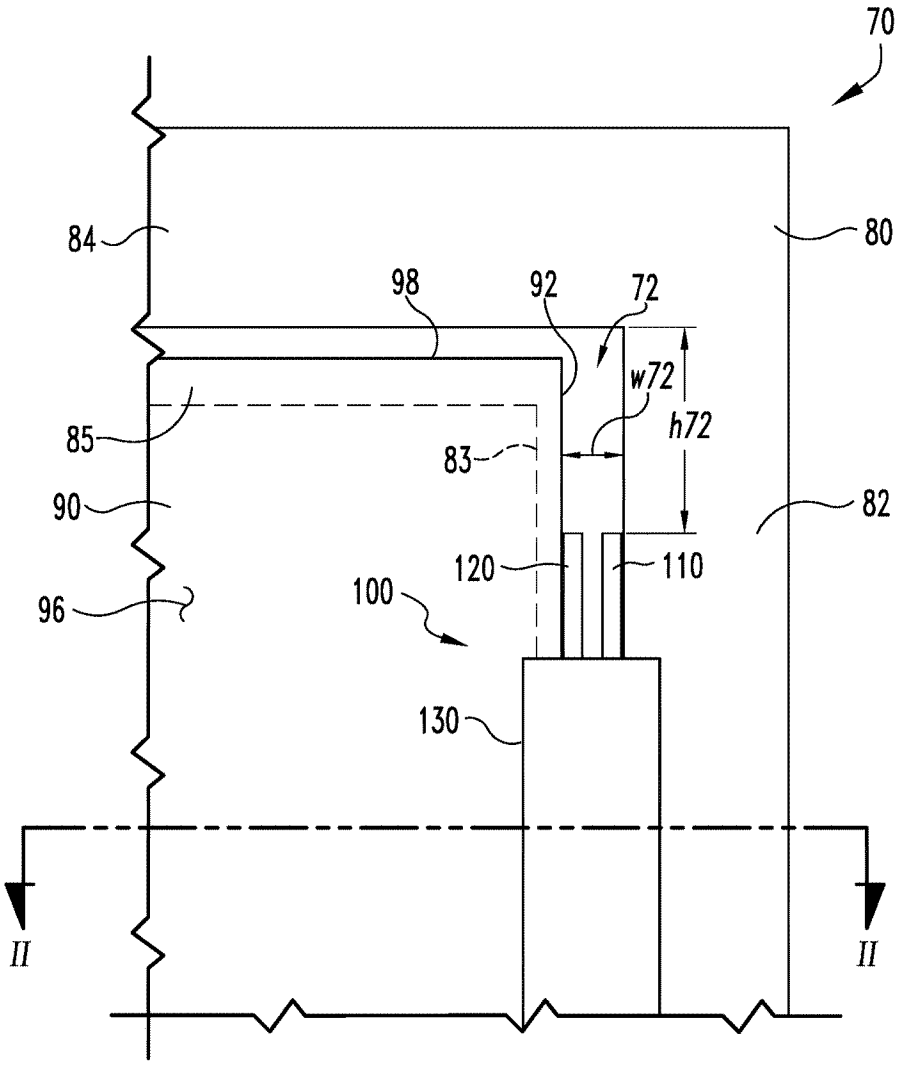
FIG. 1 is a front view of a closure assembly according to certain embodiments.

With reference to FIG. 1, illustrated therein is a closure assembly 70 according to certain embodiments. The closure assembly 70 generally includes a door frame 80, a door 90 pivotably mounted to the frame 80, and a hinge 100 by which the door 90 is pivotably mounted to the frame 80. The door frame 80 generally includes a vertical hinge jamb 82, a horizontal head 84 extending from the hinge jamb 82, and a vertical latch jamb extending downward from the head 84 parallel to the hinge jamb 82. A hinge jamb stop 83 extends from the hinge jamb 82, and a head stop 85 extends from the head 84. As described herein, the stops 83, 85 provide a stop surface against which a face of the door 90 may abut when the door 90 is in its closed position.

With additional reference to FIG. 2, the door 90 generally includes a vertical hinge edge 92 that extends between and connects a first broad face 94 and a second broad face 96 opposite the first broad face 96. The door 90 also includes a horizontal top edge 98 that extends between and connects the vertical broad faces 94, 96. When the door 90 is in its closed position, the hinge edge 92 faces the hinge jamb 82, and an upper portion of the first broad face 94 faces the head stop 85. Additionally, an open space or gap 72 is formed between the frame 80, the door 90, and the hinge 100.

The hinge 100 generally includes a frame-side first leaf 110, a door-side second leaf 120, and a connecting portion 130 hingedly connecting the first leaf 110 and the second leaf 120. With the closure assembly 70 assembled, the frame-side first leaf 110 is secured to the hinge jamb 82 of the frame 80, the door-side second leaf 120 is secured to the hinge edge 92 of the door 90, and the connecting portion 130 facilitates hinged movement of the door-side second leaf 120 and the door 90 relative to the frame-side first leaf 110 and the frame 80. In the illustrated form, the hinge 100 is provided in the form known in the art as a continuous hinge, in which the connecting portion 130 extends continuously along the longitudinal length of the hinge 100 and covers the portions that are hingedly interconnected. It is also contemplated that the hinge 100 may be provided in another form, such as a traditional form in which interleaved knuckles receive a hinge pin.

The frame-side first leaf 110 extends vertically along the hinge jamb 82 of the frame 80, and generally includes a plate portion 112 configured for mounting to the hinge jamb 82 and a body portion 114 from which the plate portion 112 extends, and may further include one or more projections 119 positioned between the plate portion 112 and the body portion 114. The plate portion 112 may include one or more apertures 113 for receiving fasteners (e.g., screws) by which the plate portion 112 is or can be secured to the hinge jamb 82. The body portion 114 is at least partially received within a channel 134 of the connecting portion 130, and is generally arcuate in geometry. A radially-inner side of the body portion 114 defines a longitudinally-extending groove 115, and a radially-outer side of the body portion 114 may define a set of gear teeth 116. The projection 119 is configured to abut the front surface of the hinge jamb 82 to ensure that the first leaf 110 is properly seated and aligned relative to the hinge jamb 82.

The door-side second leaf 120 extends vertically along the hinge edge 92 of the door 90, and generally includes a plate portion 122 configured for mounting to the hinge edge 92 and a body portion 124 from which the plate portion 122 extends, and may further include one or more projections 129 positioned between the plate portion 122 and the body portion 124. The plate portion 122 may include one or more apertures 123 (FIG. 8) for receiving fasteners (e.g., screws) by which the plate portion 122 is or can be secured to the hinge edge 92. The body portion 124 is at least partially received within the channel 134 of the connecting portion 130, and is generally arcuate in geometry. A radially-inner side of the body portion 124 defines a longitudinally-extending groove 125, and a radially-outer side of the body portion 124 may define a set of gear teeth 126 that mesh with the gear teeth 116 of the first leaf 110. The projection 129 is configured to abut the second face 96 adjacent the hinge edge 92 to ensure that the second leaf 120 is properly seated and aligned relative to the door 90.

The connecting portion 130 defines the channel 134, and further includes a pair of longitudinally-extending rails 131, 132, each of which is received in the groove 115/125 of a corresponding one of the leaves 110, 120. More particularly, a first rail 131 is received in the groove 115 of the first leaf 110 such that the first leaf 110 is pivotably coupled to the connecting portion 130, and a second rail 132 is received in the groove 125 of the second leaf 120 such that the second leaf 120 is pivotably coupled to the connection portion 130. As the door 90 pivots relative to the frame 80 between its open position and its closed position, the meshed gear teeth 116, 126 ensure that the connecting portion 130 pivots relative to the frame 80 and the door 90. In the illustrated form, the connecting portion 130 is provided as a channel member, and may alternatively be referred to as the channel member 130. In other embodiments, the connecting portion 130 may be defined at least in part by one or more of the leaves 110, 120. For example, the connecting portion 130 may be defined as a set of interleaved knuckles through which a hinge pin passes.

In the illustrated form, the hinge 100 further includes an additional projection 101 that discourages or prevents the plate portions 112, 122 from being flush with one another when the door 90 is in its closed position. While the illustrated additional projection 101 is formed on the second leaf 120, it is also contemplated that the additional projection 101 may be formed on the first leaf 110. It is further contemplated that the additional projection 101 may be omitted, in which case the plate portions 112, 122 may be flush with one another when the door 90 is in its closed position.

As will be appreciated, the hinge 100 has an open state corresponding to the open position of the door 90 and a closed state corresponding to the closed position of the door 90. In the closed state, the leaves 110, 120 face one another and define a thickness dimension t102 spanning between the outward-facing surfaces of the plate portions 112, 122. Those skilled in the art will readily appreciate that the thickness dimension t102 corresponds to the width dimension w72 of the gap 72 that is formed when the door 90 is in its closed position. The gap 72 also has a height dimension h72, which in the illustrated form is defined between the upper edges of the plate portions 112, 122 and the lower face of the head 84. It is also contemplated that the height dimension h72 may be measured from the upper edges of the plate portions 112, 122 to the top edge 98 of the door 90.

Figure 4:
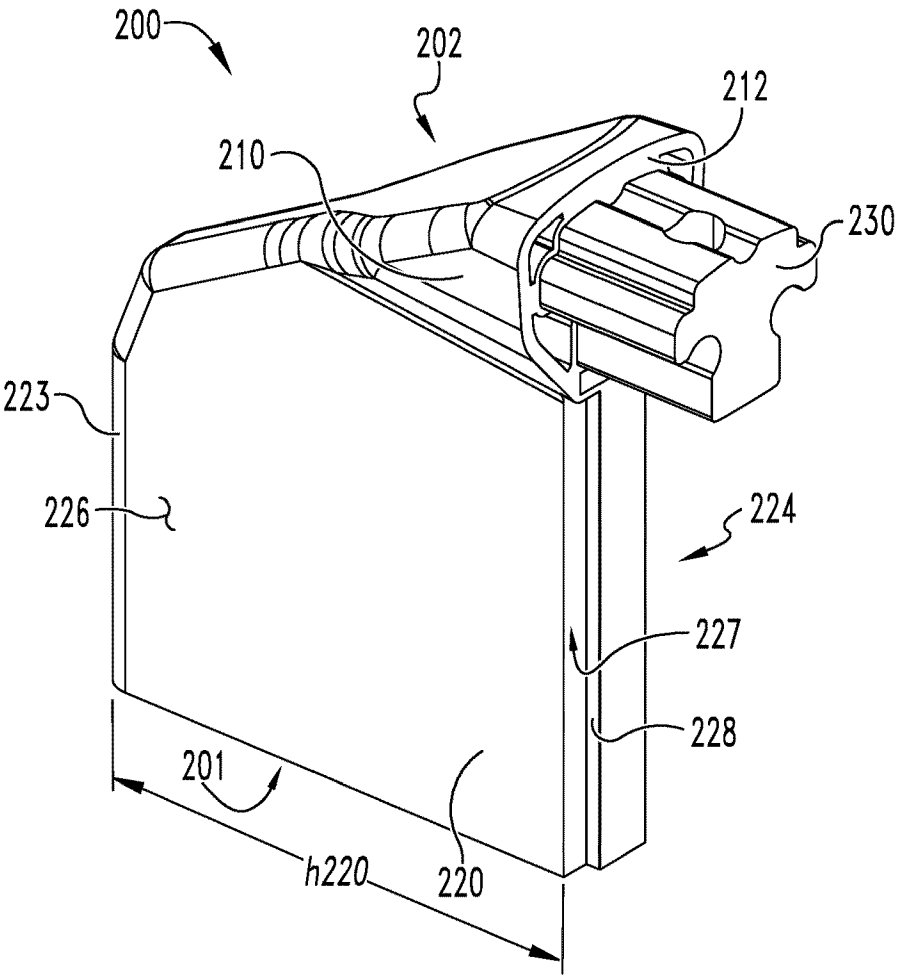
FIG. 4 is a second perspective view of the anti-ligature hinge cap illustrated in FIG. 3.
Figure 3:
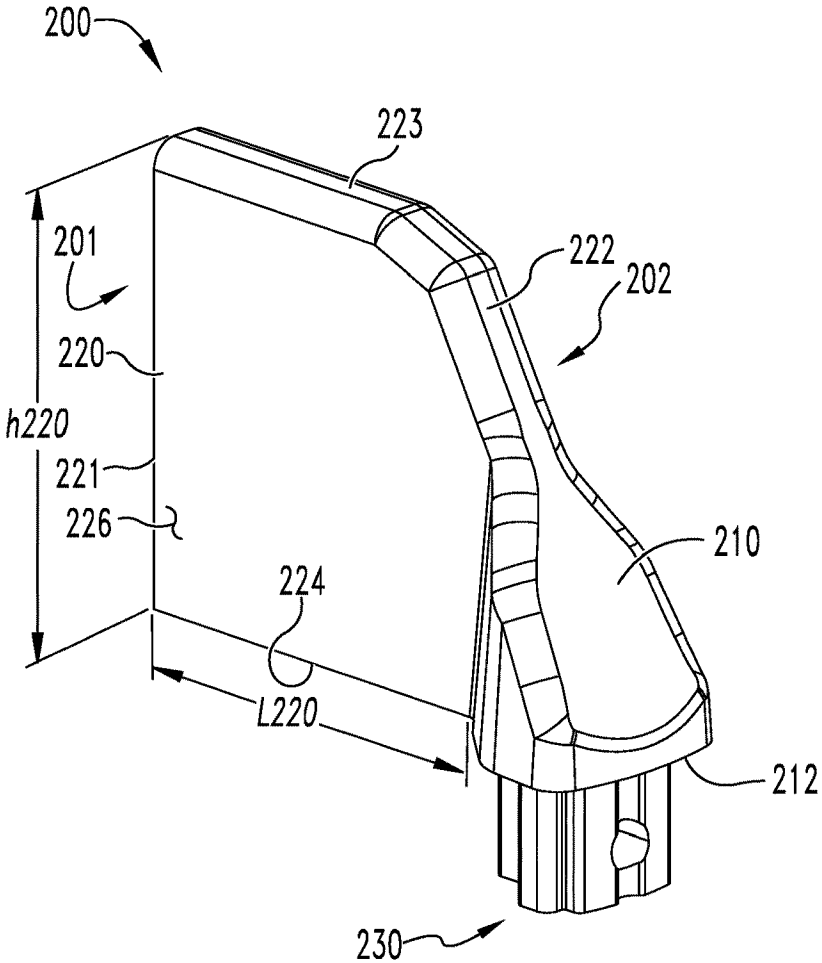
FIG. 3 is a first perspective view of an anti-ligature hinge cap according to certain embodiments.

With additional reference to FIGS. 3 and 4, illustrated therein is a ligature-resistant hinge cap 200 according to certain embodiments. The hinge cap 200 generally includes a body portion 210, a flange 220 extending rearwardly from the body portion 210, and a stem 230 extending downward from the body portion 210. In certain embodiments, the body portion 210 may be considered to include the stem 230.

The hinge cap 200 also includes a rear side 201 that is defined by the flange 220 and an opposite front side 202 that is sloped.

Figure 5:
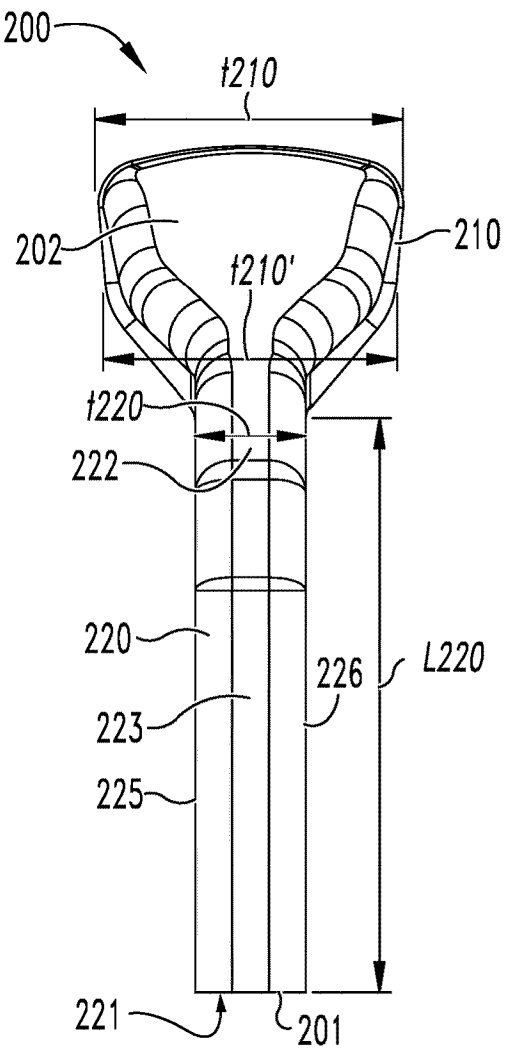
FIG. 5 is a top-down view of the anti-ligature hinge cap illustrated in FIG. 3.

With additional reference to FIG. 5, the body portion 210 is configured for mounting to the upper end 139 of the channel member 130, and at least partially defines the sloped front side 202 of the hinge cap 200. The body portion 210 includes a base 212 from which the stem 230 extends, and the base 212 has a geometry that generally corresponds to that of upper end 139 of the connecting portion 130 such that when the hinge cap 200 is mounted to the hinge 100, the base 212 is substantially flush with the upper end 139 of the channel member 130. For example, a portion of the body portion 210 has a body portion thickness dimension t210 that corresponds to the width of the channel member 130, and the base 212 tapers from this first thickness dimension t210 to a second thickness dimension t210' corresponding to the minimum width of the upper end 139 of the channel member 130.

The flange 220 is sized and shaped to substantially fill the gap 72 in order to discourage or prevent the insertion of ligatures into the gap 72. As such, various dimensions of the flange 220 are selected to correspond to corresponding and respective dimensions of the gap 72. For example, the flange 220 has a length L220 that corresponds to the depth d72 of the gap 72, a thickness t220 that corresponds to the width w72 of the gap 72, and a height h220 that corresponds to the height h72 of the gap 72. The flange 220 has rear side 221 that defines the rear side 201 of the hinge cap 200, a front side 222 that at least partially defines the front side 202 of the hinge cap 200, an upper side 223, a lower side 224 opposite the upper side 223, a jamb-facing first broad face 225, and a door-facing second broad face 226 opposite the first broad face 225. The length L220 of the flange 220 extends from the location that the body portion 210 meets the flange 220 to the rear side 221. The thickness t220 of the flange 220 extends between the first broad face 225 and the second broad face 226, and the hinge cap 200 tapers from the second thickness dimension t210' to the flange thickness t220. The height h220 of the flange 220 extends between the upper side 223 and the lower side 224. In certain forms, the lower side 224 may include an undercut 227 that is partially defined by a shoulder 228. The undercut 227 may be sized and shaped to allow for clearance with the hinge leaf and to prevent or discourage a pinching or binding condition between the hinge leaves 110, 120.

Figure 6:
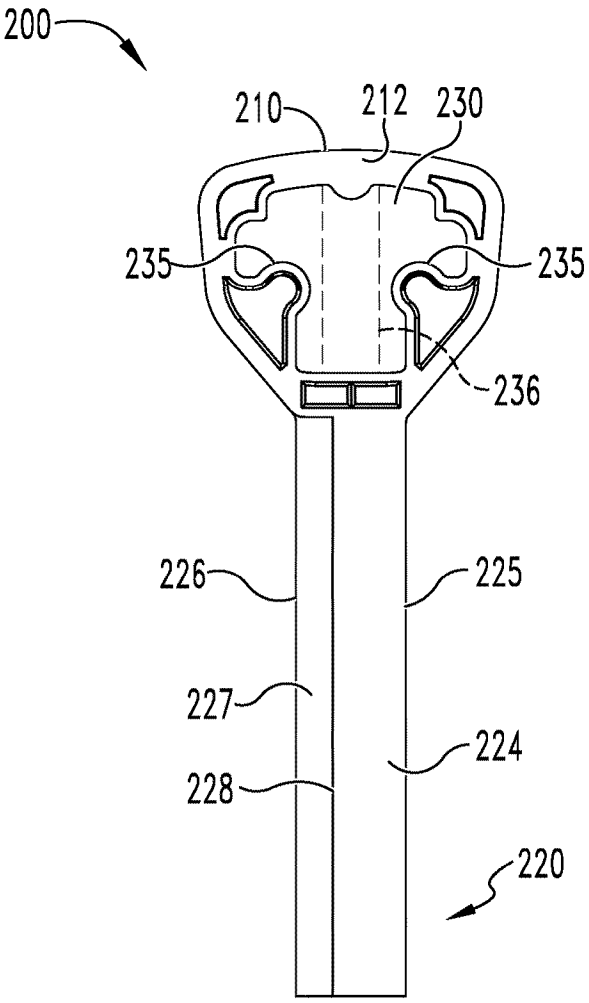
FIG. 6 is a bottom-up view of the anti-ligature hinge cap illustrated in FIG. 3.

With additional reference to FIG. 6, the stem 230 extends downward from the body portion 210, and is sized and shaped to be received in the channel 134 defined by the connecting portion 130. In the illustrated form, the stem 230 includes a pair of grooves 235 that correspond to the grooves 115, 125, and which receive the rails 131, 132 of the channel member 130 to provide lateral stability for the hinge cap 200. The illustrated stem 230 also includes an aperture 236 sized and shaped to receive a fastener (e.g., a set screw) by which the hinge cap 200 may be secured to the channel member 130. While an exemplary form of the stem 230 is illustrated in the Figures, it should be appreciated that the geometry of the stem 230 may be dictated by the geometry of the channel 134 in which the stem 230 seats. Thus, the geometry of the stem 230 may be altered, for example in the event that should the geometry of the channel member 130 and/or the rails 115, 125 is/are different from those illustrated in the Figures.

Figure 7:
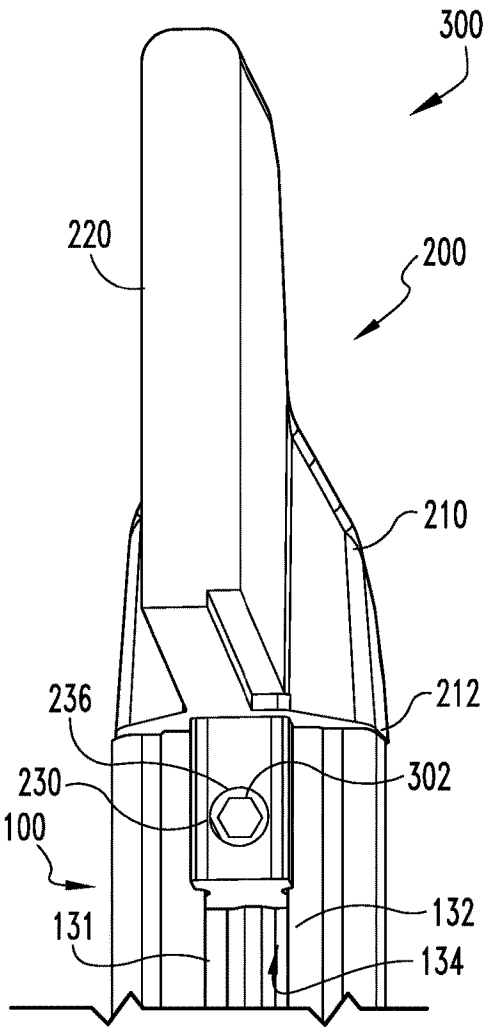
FIG. 7 is a perspective view of a portion of a hinge assembly according to certain embodiments.

With additional reference to FIG. 7, illustrated therein is a hinge assembly 300 according to certain embodiments. The hinge assembly 300 generally includes the hinge 100 and the hinge cap 200, which is mounted to the upper end 139 of the channel member. In the interest of clarity, the leaves 110, 120 are omitted from the illustration of FIG. 7. When assembled, the stem 230 is seated in the channel 134 such that the base 212 of the body portion 210 is substantially flush with the upper end 139 of the channel member 130. Additionally, a fastener such as a set screw 302 extends through the aperture 236 and engages the channel member 130 to retain engagement between the channel member 130 and the hinge cap 200. While the illustrated hinge assembly 300 includes the continuous hinge 100 illustrated in FIGS. 1 and 2, it is also contemplated that the hinge cap 200 may be utilized in connection with another form of hinge, such as a traditional form in which interleaved knuckles receive a hinge pin. For example, the hinge cap 200 may be provided with a stem that defines the hinge pin.

Figure 8:
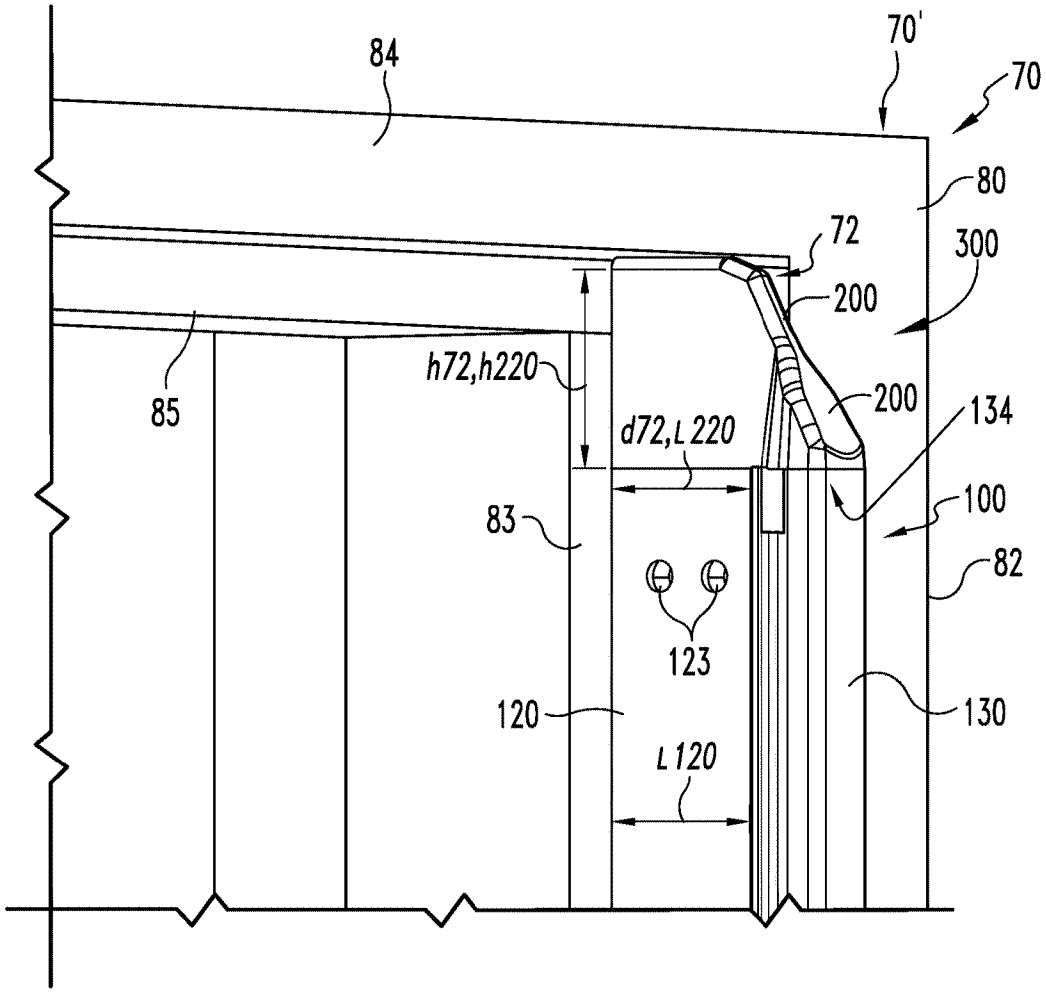
FIG. 8 is a perspective view of a closure assembly including the hinge assembly illustrated in FIG. 7.
Figure 10:
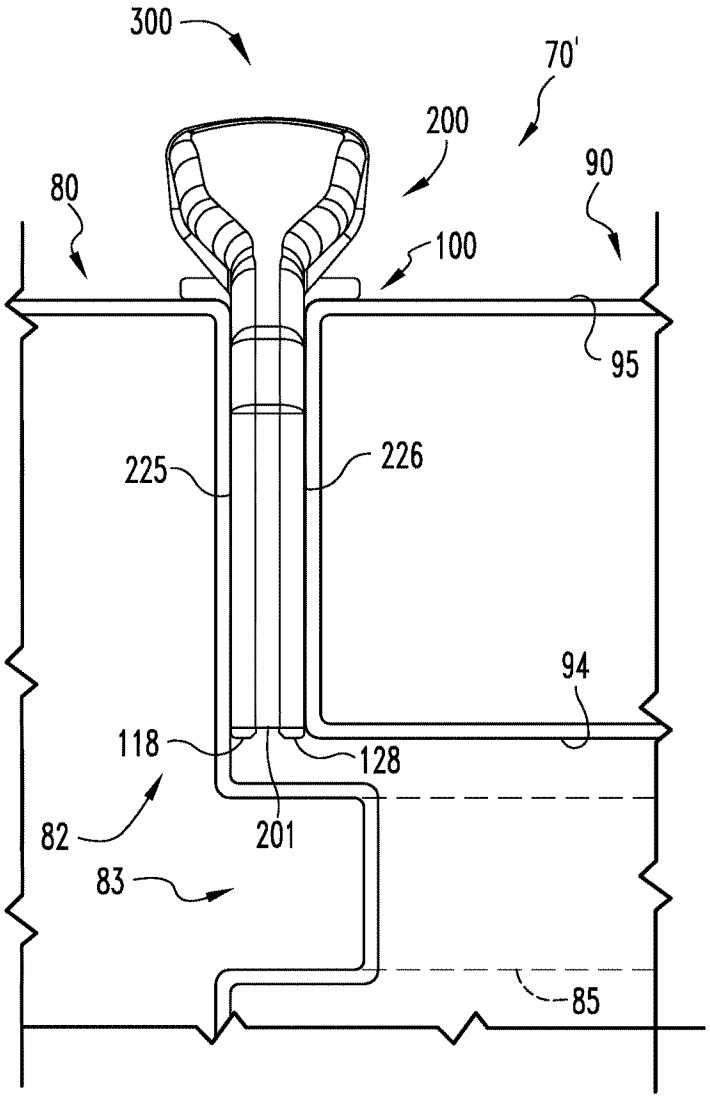
FIG. 10 is a cutaway view of the closure assembly illustrated in FIG. 8.
Figure 9:
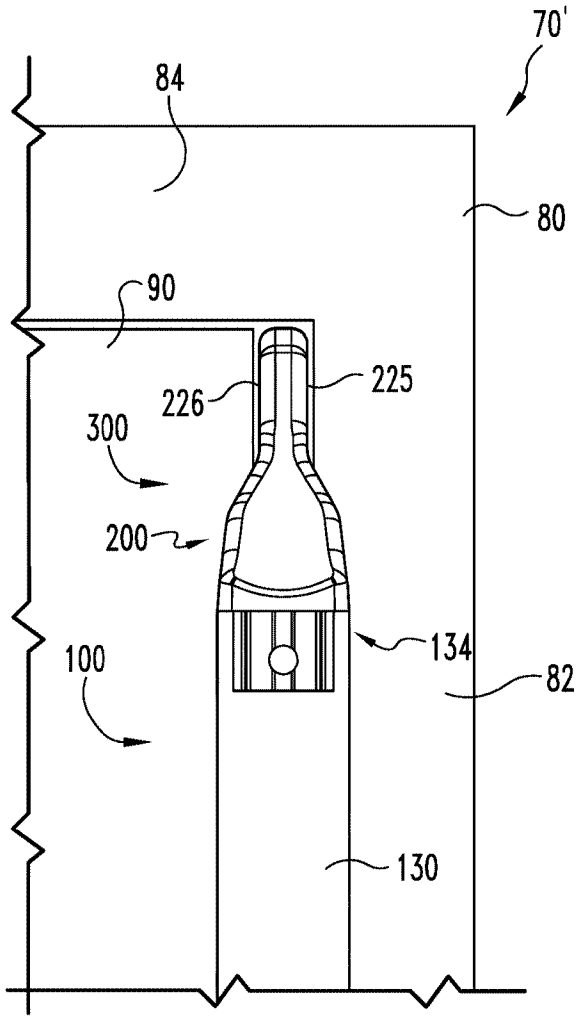
FIG. 9 is a front view of the closure assembly illustrated in FIG. 8.
Figure 12:
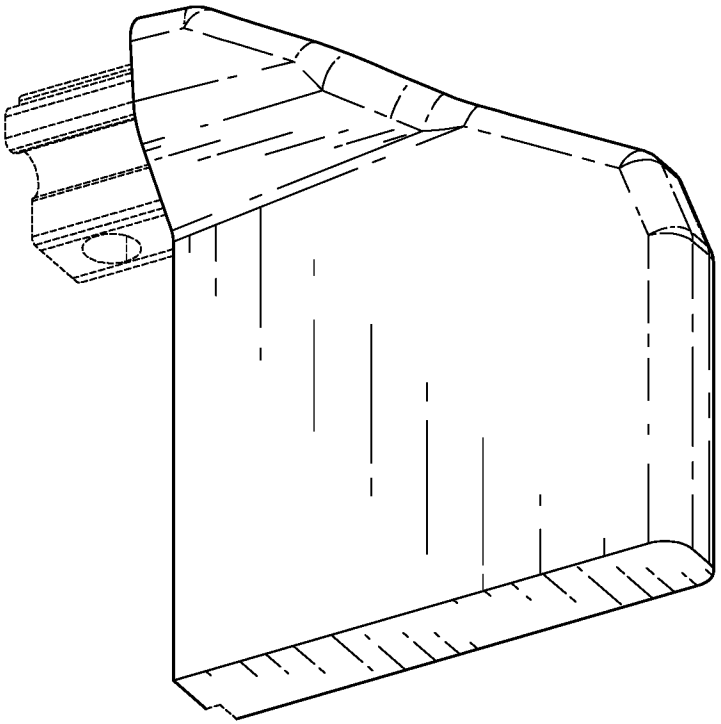
FIG. 12 is a second isometric view of the anti-ligature hinge cap illustrated in FIG. 11.
Figure 11:
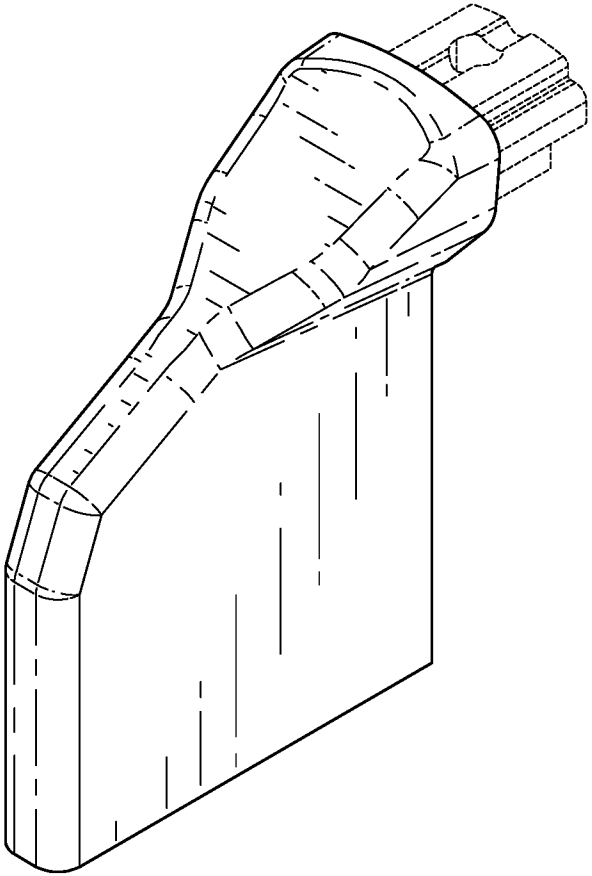
FIG. 11 is a first isometric view of an anti-ligature hinge cap according to certain embodiments.
Figure 14:
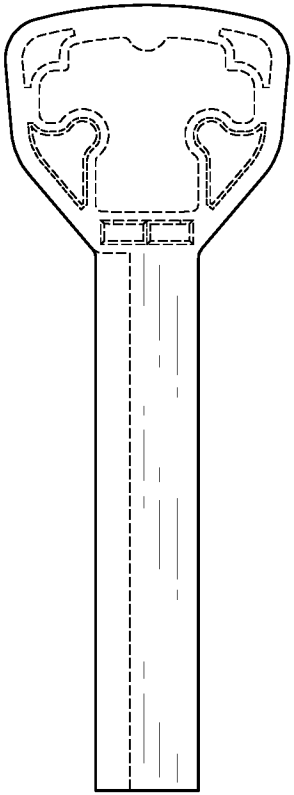
FIG. 14 is a bottom-up view of the anti-ligature hinge cap illustrated in FIG. 11.
Figure 13:
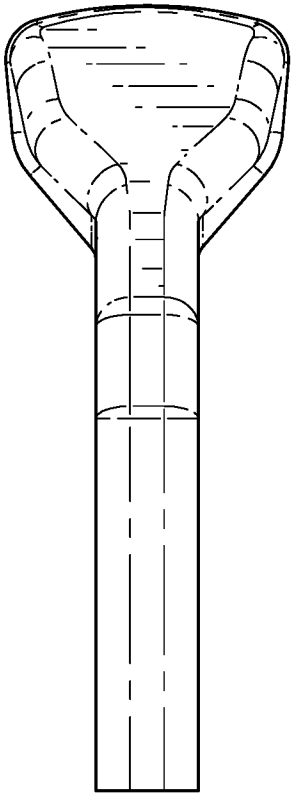
FIG. 13 is a top-down view of the anti-ligature hinge cap illustrated in FIG. 11.
Figure 16:
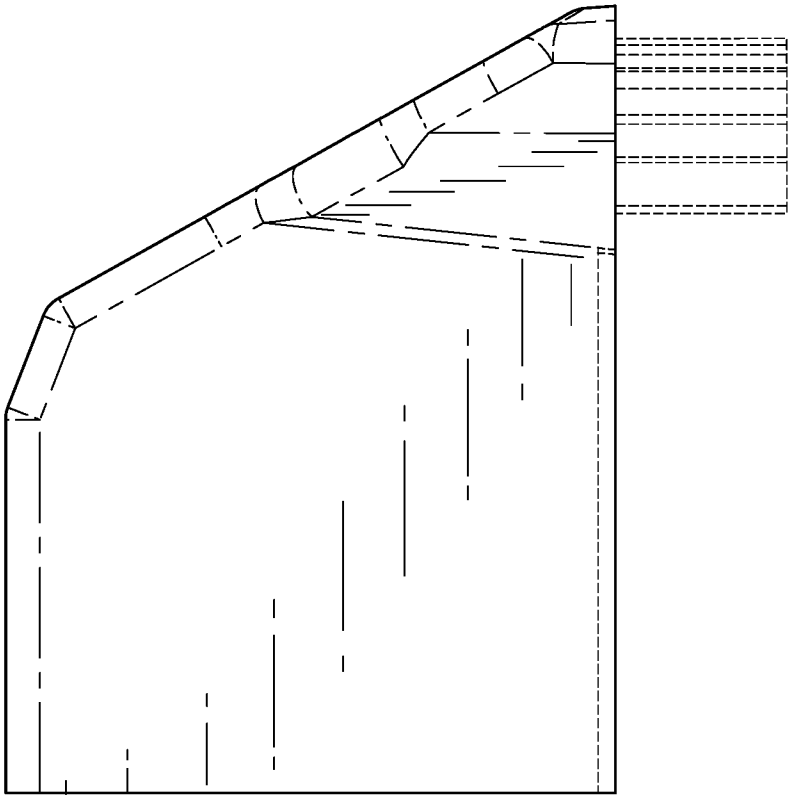
FIG. 16 is a right-side view of the anti-ligature hinge cap illustrated in FIG. 11.
Figure 15:
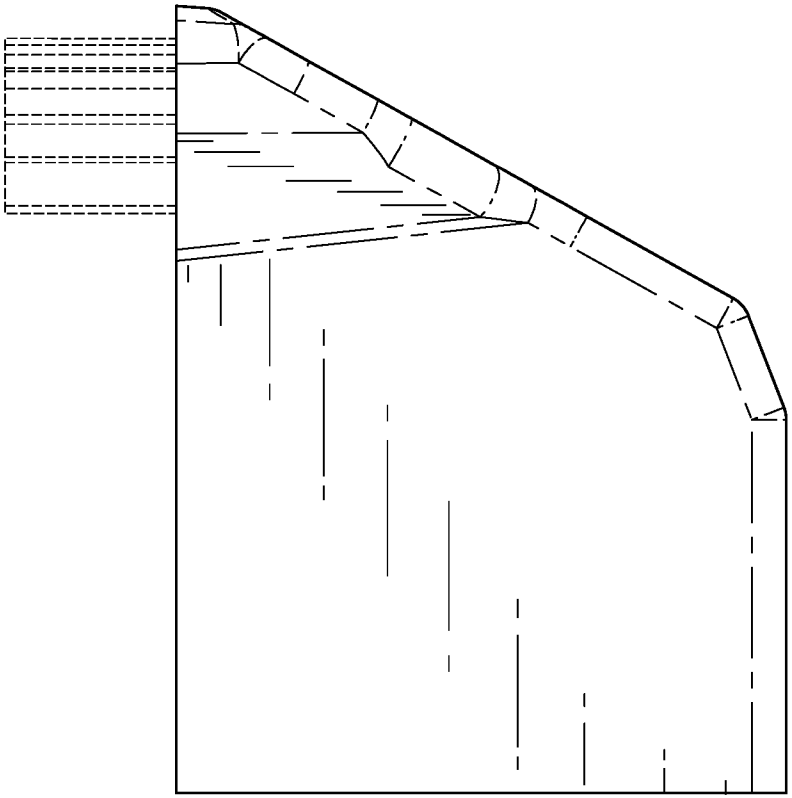
FIG. 15 is a left-side view of the anti-ligature hinge cap illustrated in FIG. 11.
Figure 18:
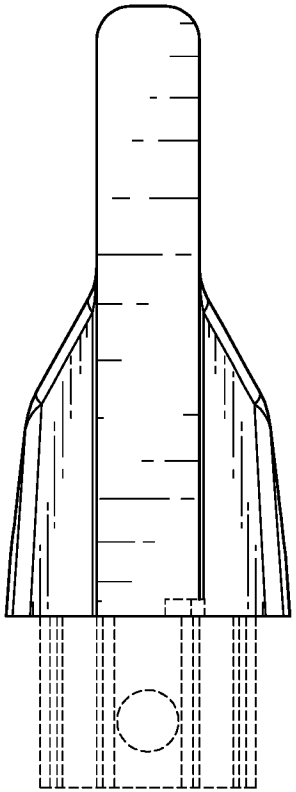
FIG. 18 is a rear-side view of the anti-ligature hinge cap illustrated in FIG. 11.
Figure 17:
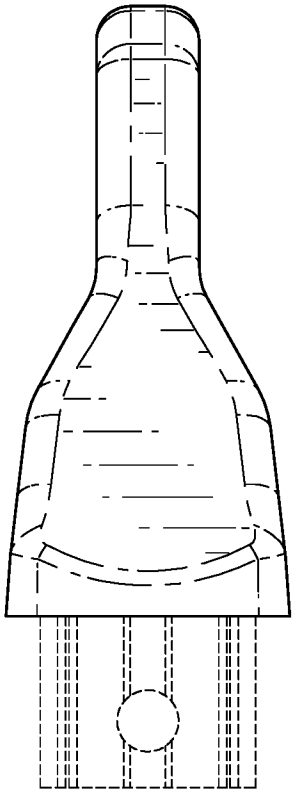
FIG. 17 is a front-side view of the anti-ligature hinge cap illustrated in FIG. 11.

With additional reference to FIGS. 8-10, illustrated therein is a closure assembly 70' according to certain embodiments, which includes the above-described closure assembly 70 and the hinge cap 200. Stated another way, the closure assembly 70 includes the door frame 80, the door 90, and the above-described hinge assembly 300. In the interests of clarity, the door 90 is not illustrated in FIG. 8.

With the closure assembly 70' assembled and the door 90 in its closed position, the gap 72 is substantially filled by the flange 220 of the hinge cap 200. More particularly, the flange 220 projects into the gap 72 such that the jamb-facing first face 225 faces the vertical interior surface of the hinge jamb 82 and the door-facing second face 226 faces the hinge edge 92. As noted above, the thickness t220 of the flange 220 may be selected to correspond to the width w72 of the gap 72. As a result, there is minimal clearance between the flange 220 and the frame 80 and minimal clearance between the flange 220 and the door 90 such that it is difficult or impossible to feed a ligature into the gap 72 while the door 90 is closed. Similarly, the height h220 of the flange 220 may be selected to correspond to the height h72 of the gap 72 such that there is minimal clearance between the upper side 223 of the flange 220 and the lower side of the head jamb 84, thereby discouraging or preventing a ligature from being fed between the upper side 223 and the head jamb 84 when the door 90 is closed.

With the door 90 in its closed position, the rear side 201 of the hinge cap 200 may be flush or substantially flush (e.g., within about a half-inch or within about a quarter-inch) with one or more other features of the closure assembly 70'. In the illustrated form, the rear side 201 of the hinge cap 200 is flush with the rear sides 118, 128 of the leaves 110, 120, and is substantially flush with the first face 94 of the door 90. Alternatively, the rear side 201 of the hinge cap 200 may be substantially flush with the rear sides 118, 128 of the leaves 110, 120, and flush with the first face 94 of the door 90. In other embodiments, the rear side 201 of the hinge cap 200 may not necessarily be flush or substantially flush with the rear sides 118, 128 and/or the first face 94.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method of discouraging hanging of ligatures from a closure assembly comprising a frame, a hinge mounted to the frame, and a door mounted to the hinge such that a gap is defined between a hinge side of the door and a hinge jamb of the frame, the method comprising:

attaching a ligature-resistant hinge cap to a top of the hinge such that a flange of the ligature-resistant hinge cap is received in the gap.

2. The method of claim 1, wherein the flange defines a rear side of the ligature-resistant hinge cap;

wherein the ligature-resistant hinge cap further comprises a front side opposite the rear side; and wherein the front side is sloped.

3. The method of claim 2, wherein the frame further comprises a head jamb including a head stop;

wherein the door further comprises a first face and a second face;

wherein an upper portion of the first face faces the head stop; and wherein the rear side of the flange is positioned adjacent the first face.

4. The method of claim 1, wherein the ligature-resistant hinge cap further comprises a body portion from which the flange extends; and wherein a base of the body portion is flush with the top of the hinge.

5. The method of claim 1, wherein the frame further comprises a head jamb; and wherein a top of the flange is adjacent the head jamb when the ligature-resistant hinge cap is attached to the top of the hinge.

6. A hinge assembly having an open state and a closed state, the hinge assembly comprising:

a first leaf configured for coupling to a door frame, wherein a portion of the first leaf is configured to abut a front face of the door frame;

a second leaf configured for coupling to a door, wherein a portion of the second leaf is configured to abut a front face of the door;

a connecting portion pivotably coupling the first leaf and the second leaf; and a ligature-resistant hinge cap, comprising:

a body portion mounted to the connecting portion; and a flange extending from the body portion beyond the portion of the first leaf that is configured to abut the front face of the door frame and beyond the portion of the second leaf that is configured to abut the front face of the door.

7. The hinge assembly of claim 6, wherein the ligature-resistant hinge cap is separable from the connecting portion.

8. The hinge assembly of claim 6, wherein the connecting portion defines a channel; and wherein the body portion comprises a stem extending into the channel.

9. The hinge assembly of claim 8, further comprising a fastener extending through an opening in the stem and securing the hinge cap to the connecting portion.

10. The hinge assembly of claim 8, wherein the connecting portion comprises a pair of rails to which the first leaf and the second leaf are rotatably mounted; and wherein the stem comprises a pair of grooves that receive the pair of rails.

11. The hinge assembly of claim 6, wherein the first leaf and the second leaf together define a first thickness dimension when the hinge assembly is in the closed state; and wherein the flange has a second thickness dimension corresponding to the first thickness dimension.

12. The hinge assembly of claim 11, wherein the second thickness dimension is no greater than the first thickness dimension.

13. The hinge assembly of claim 6, wherein a rear side of the flange is aligned with a rear side of the first leaf when the hinge assembly is in the closed state.

14. A closure assembly comprising the hinge assembly of claim 6, the closure assembly further comprising:

the door frame, the door frame comprising a hinge jamb, wherein the hinge jamb is coupled with the first leaf; and the door, the door comprising a hinge edge, wherein the hinge edge is coupled to the second leaf and faces the hinge jamb such that a gap is defined between the hinge edge and the hinge jamb;

wherein the flange extends into the gap.

15. A ligature-resistant hinge cap configured for use with a hinge, the ligature resistant hinge cap comprising:

a body portion comprising a base configured to cover a top of a connecting portion of the hinge;

a flange extending rearward from the body portion beyond a rear side of the body portion;

a rear side defined by the flange; and a front side opposite the rear side, wherein the front side is sloped.

16. The ligature-resistant hinge cap of claim 15, wherein the flange has a first thickness dimension;

wherein a portion of the body portion has a second thickness dimension greater than the first thickness dimension; and wherein the ligature-resistant hinge cap tapers from the second thickness dimension to the first thickness dimension.

17. The ligature-resistant hinge cap of claim 15, wherein the body portion further comprises a downwardly-extending stem configured to extend into the connecting portion; and further comprising a fastener, wherein the fastener is seated in an aperture formed in the stem.

18. The ligature-resistant hinge cap of claim 15, wherein the flange comprises a bottom side and an opposite top side, and wherein the bottom side comprises an undercut defined at least in part by a shoulder.

19. The ligature-resistant hinge cap of claim 15, wherein the body portion further comprises a downwardly-extending stem configured to extend into the connecting portion; and wherein the stem includes a pair of grooves configured to receive a pair of rails of the connecting portion.

20. A method of using the ligature-resistant hinge cap of claim 15, the method comprising:

positioning the base portion above the top of the connecting portion of the hinge, thereby covering the top of the connecting portion of the hinge; and positioning the flange within a gap defined between a hinge side of a door and a hinge jamb of a door frame.

* * * * *